United States Patent [19]

Wilson et al.

[11] Patent Number: 4,511,297

[45] Date of Patent: Apr. 16, 1985

[54] APPARATUS AND METHOD FOR OFFSETTING AND DELAYING DELIVERY OF SHEETS IN AN ADHESIVE BINDER

[75] Inventors: William C. Wilson; Michael H. Green, both of Rochester, N.Y.

[73] Assignee: Eastman Kodak Company, Rochester, N.Y.

[21] Appl. No.: 422,069

[22] Filed: Sep. 23, 1982

[51] Int. Cl.[3] ..... B42B 5/00; B05B 1/28; B42C 9/00

[52] U.S. Cl. ..... 412/8; 156/356; 355/14 SH; 412/37

[58] Field of Search ..... 156/356, 358, 364, 558, 156/563, 566, 517; 270/58; 271/225; 355/14 SH; 412/7, 9, 8, 37, 902

[56] References Cited

U.S. PATENT DOCUMENTS

| | | |
|---|---|---|
| 1,841,539 | 1/1932 | Kleinschmit . |
| 2,024,932 | 12/1935 | Kushera et al. . |
| 2,844,368 | 7/1958 | Dexter et al. . |
| 3,052,466 | 9/1962 | Prince et al. . |
| 3,114,543 | 12/1963 | Bishop et al. . |
| 3,145,828 | 8/1964 | Hawley . |
| 3,404,880 | 10/1968 | Porter et al. . |
| 4,073,391 | 2/1978 | O'Brien et al. . |
| 4,134,672 | 1/1979 | Burlew et al. . |

OTHER PUBLICATIONS

Research Disclosure, Mar. 1981, pp. 130, 131, Item 20341.

*Primary Examiner*—Paul A. Bell
*Attorney, Agent, or Firm*—G. Herman Childress

[57] ABSTRACT

In an adhesive binder sheets received in an upper tray are driven past an adhesive applicator, through an inverting path and into a lower tray where the sheets are jogged and aligned. As the sheets are moved past the adhesive applicator, adhesive is applied to all but one sheet so that the sheets in the lower tray have adhesive between each two adjacent sheets. After a complete set of sheets are received in the lower tray, a bar applies pressure to the sheets in the area of the adhesive to form a booklet, and then the completed booklet is removed from the lower hopper. In accordance with the apparatus and method of the present invention, the first two sheets of a set of sheets are offset and then stopped during movement between the upper tray and the lower tray in order to provide sufficient time for the preceeding booklet to be finished and removed from the lower tray.

9 Claims, 5 Drawing Figures

APPARATUS AND METHOD FOR OFFSETTING AND DELAYING DELIVERY OF SHEETS IN AN ADHESIVE BINDER

CROSS REFERENCE TO A RELATED APPLICATION

Reference is made to the copending, commonly assigned U.S. patent application Ser No. 380,966, entitled BINDING APPARATUS AND METHOD filed on May 24, 1982 in the names of R. C. Baughman, D. S. Bump and C. R. Hubbard.

BACKGROUND OF THE INVENTION

This invention relates to apparatus and methods for applying adhesive to sheets of a set and assembling the sets into a bound booklet.

U.S. Pat. No. 3,404,880 issued on Oct. 8, 1968 in the names of H. R. Porter, Jr. et al for a GLUING ATTACHMENT FOR A COLLATING MACHINE. The apparatus disclosed in the Porter Jr. et al patent comprises a collator which holds stacks of sheets adjacent to a conveyor, and sheet transfer means which transfers individual sheets onto the conveyor. As each sheet is lifted from the stack and placed on the conveyor a small spot of glue is applied to the sheet so that when the sheets are assembled into a booklet the glue is effective to hold the sheets together. U.S. Pat. No. 3,114,543 issued to L. H. Bishop et al on Dec. 17, 1963 and also discloses a collator/binder for producing forms wherein rows of adhesive are applied to all but one sheet of a form and then the sheets are pressed together.

Automated sheet binding apparatus and methods for producing booklets on an on-line basis is disclosed in the beforementioned U.S. patent application Ser No. 380,966 entitled BINDING APPARATUS AND METHOD. As disclosed in such application, sets of sheets are fed seriatim from a copier/duplicator or the like directly into the binding apparatus. The individual sheets of a set are quickly advanced through the binder where adhesive is applied to all but one sheet of the set, the sheets are assembled into sets in an assembly tray with the adhesive between adjacent sheets, the sheets are pressed together in the area of the adhesive, and a completed booklet is discharged from the assembly tray to a tote tray. Some finishing operations in the assembly tray occur after the last sheet of a set is received in the assembly tray. For example, a pressure bar assembly compresses the sheets of the set in the area directly over the adhesive to assist in formation of the booklet. After the pressure bar assembly has been retracted, the assembly tray swings to an open position, and the completed booklet drops from the tray into a tote tray. When the binding apparatus works in connection with copier/duplicators having a relatively high output rate (e.g., 4,000 to 8,000 copies per hour) it is important that the steps required for completing one booklet be carried out prior to the time the first sheet of the next set of sheets reaches the assembly tray. Time for completing the finishing steps and removing the booklet from the tray can be obtained by controlling the copier/duplicator so that there is a time delay between delivery of sets of sheets to the binder. However, it clearly is more desireable to provide binding apparatus which can receive sets of sheets as fast as they are produced by the copier/duplicator and without interfering with the normal machine cycle of the copier/duplicator.

A similar problem occurs in a finisher for producing stapled booklets from sets of copies received from a copier/duplicator. Such a finisher is disclosed in commonly assigned U.S. Pat. No. 4,134,672 which issued on Jan. 16, 1979 in the names of Burlew et al and entitled COPIER FINISHER FOR AN ELECTROPHOTOGRAPHIC REPRODUCING DEVICE. The stapler finisher disclosed in such patent feeds a set of sheets into an assembly tray, jogs the sheets into alignment and then applies one or more staples to the set to form a booklet. Then the completed booklet is removed from the assembly tray and delivered to a tote tray where a stack of such booklets can be accumulated. The steps of jogging, stapling and removing of a finished booklet from the assembly tray does require a finite period of time during which time sheets of another set can be delivered to the finisher from the copier/duplicator. Therefor. the finisher provides a momentary interruption in the flow of sheets to the assembly tray by braking a pair of nip rollers located along the path traveled by the copy sheets between the copier/duplicator and the assembly tray. More specifically, the first two copy sheets of a set travelling along the sheet path are held up at the nip rollers. This provides sufficient time for the preceeding set of copy sheets to be jogged, stapled, and removed from the assembly tray before sheets of the next set are fed to the tray. While merely braking a pair of nip rollers along the sheet path is sufficient to provide the needed time in a stapler finisher of the type disclosed in such patent, this solution is not entirely satisfactory in an adhesive binder because the accumulation of two sheets along the common sheet path leading to the assembly tray will cause wiping of adhesive along the interface between the two sheets as the second sheet moves along the first sheet before the second sheet reaches the nip. Such wiping of the adhesive can remove a sufficient portion of the adhesive from the desired area of the sheet to cause an unsatisfactory bond to be produced between the sheets when they are finally delivered to the assembly tray for formation into a booklet.

SUMMARY OF THE INVENTION

In one aspect the present invention relates to an improvement in an adhesive binder for forming bound booklets from sets of sheets. The binder has means for applying liquid adhesive to a side edge portion of one or more sheets of each set of sheets, and a tray where sheets of each set are assembled to form a bound booklet. The improvement comprises means for advancing the sheets seriatim toward the assembly tray. Means are provided for temporarily stopping advancement of the first and second sheets of a set after such sheets have passed the adhesive applying means and before such sheets reach the tray so that there is a brief period of time for removing a booklet from the tray before sheets of the next booklet are advanced to the tray. Means are provided for offsetting the first and second sheets so that when such sheets are stopped by the stopping means adhesive on one sheet is spaced from the side edge of the other sheet, thereby to avoid removal of adhesive from such one sheet.

In another aspect the invention relates to an improved method for forming bound booklets from sets of sheets by applying liquid adhesive to a side edge portion of one or more sheets of each set of sheets advancing the sheets to an assembly area, and assemblying the sheets of each set together to form a bound booklet. The improved method comprises temporarily stopping advancement of the first and second sheets of a set after adhesive has been applied to the second of such sheets and before such sheets reach the assembly area so that there is a brief period of time for removing a booklet from the assembly area before sheets of the next booklet are advanced to the assembly area. Also, the first and second sheets are offset so that when such sheets are stopped adhesive on the second sheet is spaced from the first sheet, thereby to avoid removal of adhesive from the second sheet.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

The present invention is particularly useful in connection with a binding apparatus and method as disclosed in the before-mentioned copending U.S. patent application Ser No. 380,966, entitled BINDING APPARATUS AND METHOD. Accordingly, the following general description of portions of the binding apparatus and method in such application will facilitate an understanding of the present invention.

Figure 1:
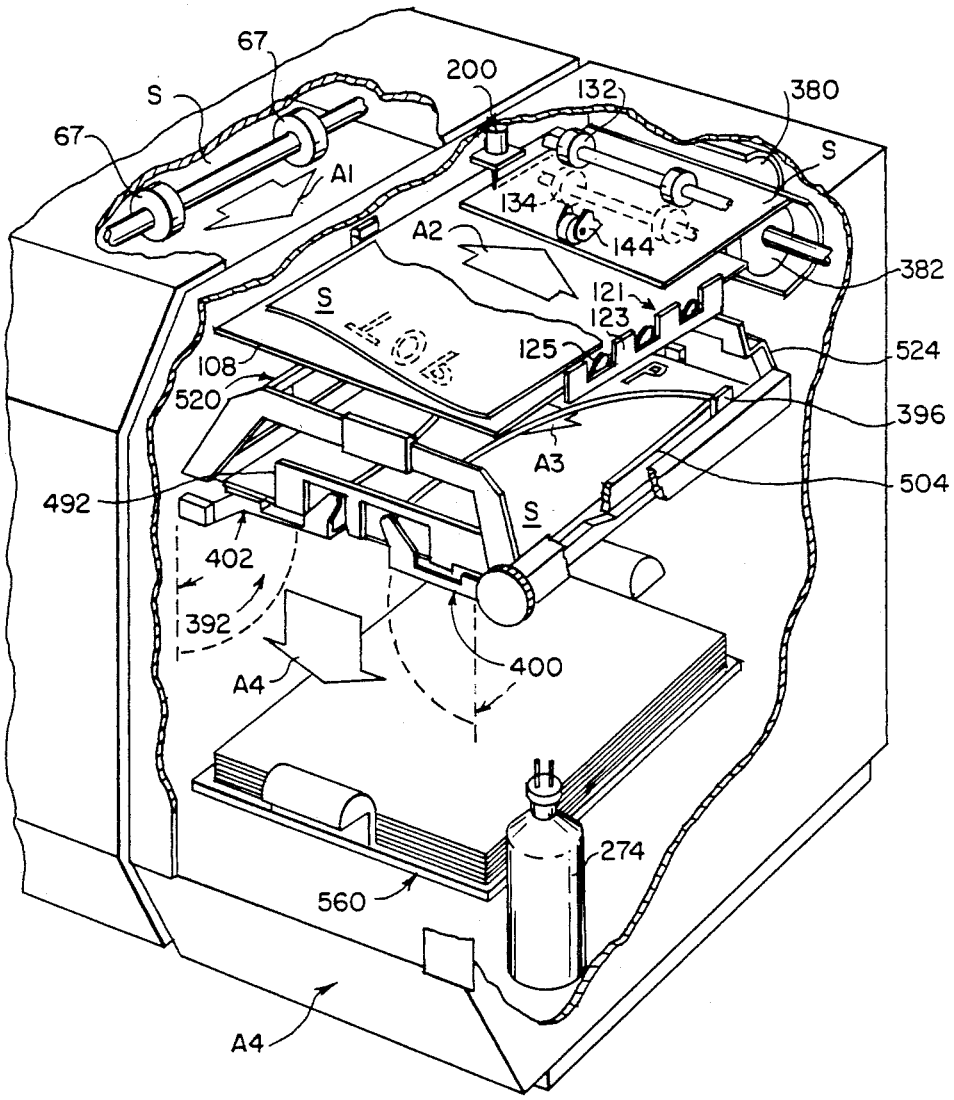
FIG. 1 is a perspective view of binding apparatus incorporating apparatus of the present invention with certain portions of the binding apparatus being cut away to facilitate understanding of the invention.

FIG. 1 of the drawings illustrates a binder generally designated 44 which is described in detail in the before-mentioned patent application. The binder is adapted to receive one or more sets of copy sheets S that are to be bound together into booklets using an adhesive material. The sheets are delivered to the binder by drive apparatus including sets of drive rollers and pressure rollers, including the rollers shown at 67 in FIG. 1. A set of sheets to be formed together into a booklet will be delivered to the binder in a particular page sequential order. For example, preferably the sheet containing the last page of a set of sheets will be delivered first and the first page of the set of sheets will be delivered last. Thus the sheets are fed to the binder seriatim beginning with the last sheet or page of a booklet and ending with the first sheet or page of a booklet.

As copy sheets S enter the binder they are traveling in a left-to-right direction as shown by arrow A1 and as viewed from the front of the binder. The sheets S then drop downwardly onto an alignment tray 108. During movement in direction A1 the trailing edge of the sheet is the side edge that is to be bound to other sheets. The sheets are delivered to the tray so that the top of a sheet is near the front of the binder and with the copied information on simplex (one-sided) copy sheets being on the bottom face of the sheet and thus facing downwardly, as shown in FIG. 1. When duplex (two-sided) copy sheets are delivered to the binder, the information on the bottom face of the sheet normally comprises the odd page number of the sheet or the page that is first in reading the document.

Figure 2:
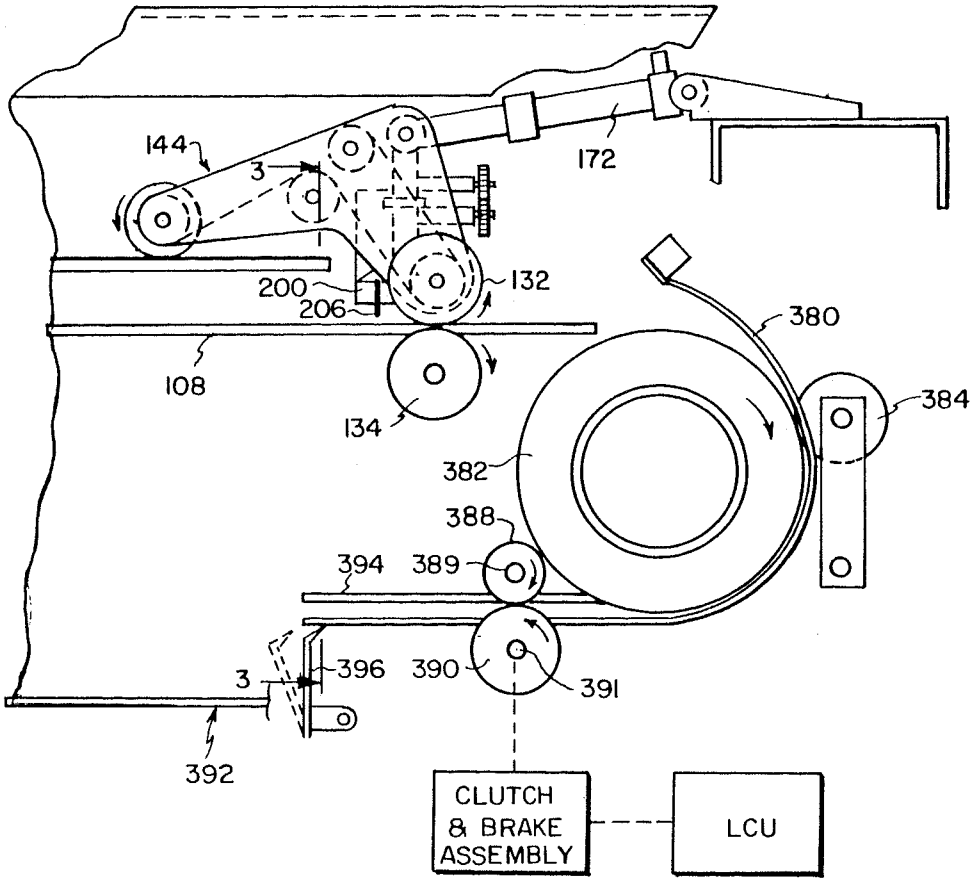
FIG. 2 is a fragmentary side elevation view of the portion of the binder incorporating the apparatus of the present invention.

After the trailing edge of the sheet enters tray 108 it is engaged by a side jogger 126 and urged to the right against a side guide of the present invention described in detail later. Then a puck drive mechanism 144 is swung from a storage position above tray 108 as shown in FIG. 2 to an operating position (not shown) in engagement with the sheet in tray 108. The drive mechanism immediately drives the sheet toward the rear of the binder and into the nip between pairs of drive rollers 132 and idler rollers 134. Promptly after the sheet enters the nip between the rollers 132, 134, the puck drive mechanism 144 is returned to its raised position so that the next sheet can be delivered to the tray 108. A pneumatic cylinder 172 moves puck drive mechanism between its positions.

Puck drive mechanism 144 and the rollers 132, 134 drive the left side edge of the sheet past an adhesive applicator generally designated 200. The direction of movement of the sheet at this time, as illustrated by arrow A2 in FIG. 1, is perpendicular to the direction of movement indicated by arrow A1. The first sheet of a booklet set delivered to tray 108 (which ordinarily is the last sheet or a back cover of the set) does not receive any adhesive as it passes the applicator 200.

Immediately after the first sheet is driven from tray 108, and just before the second sheet of a set reaches the applicator, a liquid adhesive begins flowing through the tip 206 of applicator 200 in a constant stream. Adhesive is delivered to the applicator from an adhesive cartridge 274 by an adhesive dispensing system (not shown). The flow of adhesive continues without interruption until the second sheet completely passes the applicator, thereby applying a continuous line of adhesive to the upper surface of the sheet from the bottom edge to the top edge of the sheet. Adhesive flow is stopped immediately after the trailing edge of the second sheet passes the applicator. This on-off operation of the applicator is repeated until a stripe of adhesive is applied to all sheets of a set of copy sheets after the first sheet of the set. By way of example, the flow of adhesive can be initiated about twenty milliseconds before a sheet reaches the applicator nozzle and terminated about twenty milliseconds after a sheet passes the nozzle. This control of the flow of adhesive to all but the first sheet is repeated for all sets of copy sheets delivered to the binder.

The first and/or last sheet can be cover sheets for a booklet. If a second (top) cover sheet is provided, adhesive also is applied to that sheet.

Figure 3:
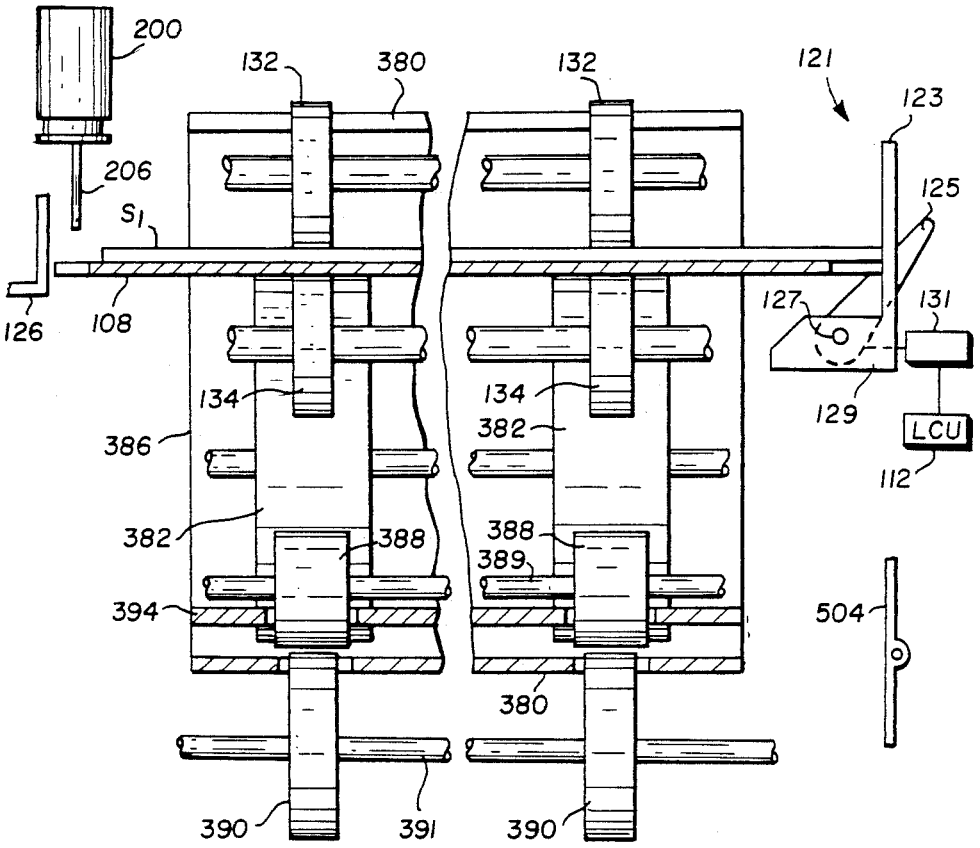
FIG. 3 is a view generally taken along lines 3—3 in FIG. 2 and further illustrating the first sheet of a booklet after delivery to the binder and prior to delivery to the assembly tray.

Sheets driven from tray 108 and past applicator 200 then travel along a curved sheet guide 380 and between sets of large, soft drive rollers 382 and idler rollers 384. As illustrated in FIG. 3, the left side edge 386 of guide 380 is offset to the right from tip 206 of the applicator so that any adhesive on a sheet is spaced from the guide 380 as it is advanced along the guide.

Advancement of a sheet along guide 380 inverts the sheet and feeds it into the nip between sets of idler rollers 388 on a shaft 389 and drive rollers 390 on drive shaft 391. The sheet then travels along a lower, generally horizontal portion of guide 380 and into an assembly tray 392. A guide plate 394 just above the horizontal portion of guide 380 helps guide the sheet into tray 392.

Tray 392 has two pivoted portions 400, 402. When a sheet enters the assembly tray 392, it is traveling in a direction, illustrated by arrow A3 in FIG. 1, which is opposite to the direction A2 of the sheets leaving tray 108. Sheets enter the tray 392 with information copied onto simplex copy sheets facing upwardly and with the top of the sheet near the rear of the tray. As a sheet enters the tray 392, its rear (top) edge is engaged by a jogger 396 which urges the leading edge of the sheet firmly against a sheet registration member 492. Also, a side jogger 504 engages one side edge of each sheet and urges it against the surface of another registration member (not shown) at the side of tray 392 opposite from jogger 504.

A pressure bar assembly 520 is normally in its raised position, as illustrated in FIG. 1 of the drawings, where it is out of the path of sheets entering tray 392. After each group of a few sheets (e.g., 2–4 sheets) is delivered to the assembly tray 392, the pressure bar assembly is driven downwardly into engagement with the sheets in the assembly tray for a brief period of time. The bar engages the upper surface of the top sheet along a line directly overlying the adhesive on the lower surface of the sheet. Pressure bar assembly 520 thus periodically compresses the sheets stacked in the assembly tray in the area of the adhesive to effect a firm bond between adjacent sheets. The pressure bar assembly 520 also presses downwardly on the uppermost sheet after the last sheet of a set is delivered to the assembly tray. This last sheet of the set normally is the first sheet or cover sheet of a copy set. As explained in detail later, the present invention permits the pressure bar assembly 520 to press against the set of sheets in tray 392 for an extended period of time after the last sheet of a set is delivered to the tray by temporarily stopping advancement of sheets of the next set before they reach tray 392.

When a complete set of copy sheets has been assembled and bound together into a booklet in the tray 392, tray portions 400, 402 are swung from their generally horizontal positions shown in solid lines in FIG. 1 to their generally vertical positions as diagramatically shown by the dotted lines in FIG. 1. This opens the bottom of the tray and allows the completed booklet to drop through the assembly tray and onto a tote tray 560 looated beneath the assembly tray. Such movement of the booklet is illustrated by arrow A4 in FIG. 1. A more comprehensive description of the binder apparatus 44 described hereinbefore can be found in the referenced copending patent application.

In accordance with the present invention, the binding apparatus disclosed in the beforementioned patent application is modified to provide means for temporarily stopping advancement of the first and second sheets of the set, and for offsetting the first and second sheets to provide a brief period of time for removing one booklet from the assembly tray 392 before the first and second sheets of the next booklet are fed into the tray. More particularly, the present invention includes an adjustable side guide generally designated 121. The side guide comprises a plurality of fixed, spaced, vertically disposed members 123 located along the side edge portion of tray 108 opposite from the side edge jogger 126. Guide 121 also includes a plurality of finger-like edge guide members 125 which are movable relative to members 123 between a retracted position illustrated in FIGS. 1 and 3 and a raised position illustrated in FIGS. 4 and 5. The fingers can be moved between their positions in any suitable manner. For example, the fingers can be secured to a shaft 127 that rotates in a support 129. One of the fingers is coupled to a solenoid 131 so that the solenoid is effective when energized to move the fingers between their two positions. The solenoid is coupled to the logic and control unit (LCU) 112 of the binder so that fingers 125 can be moved in response to control signals from the LCU.

Figure 4:
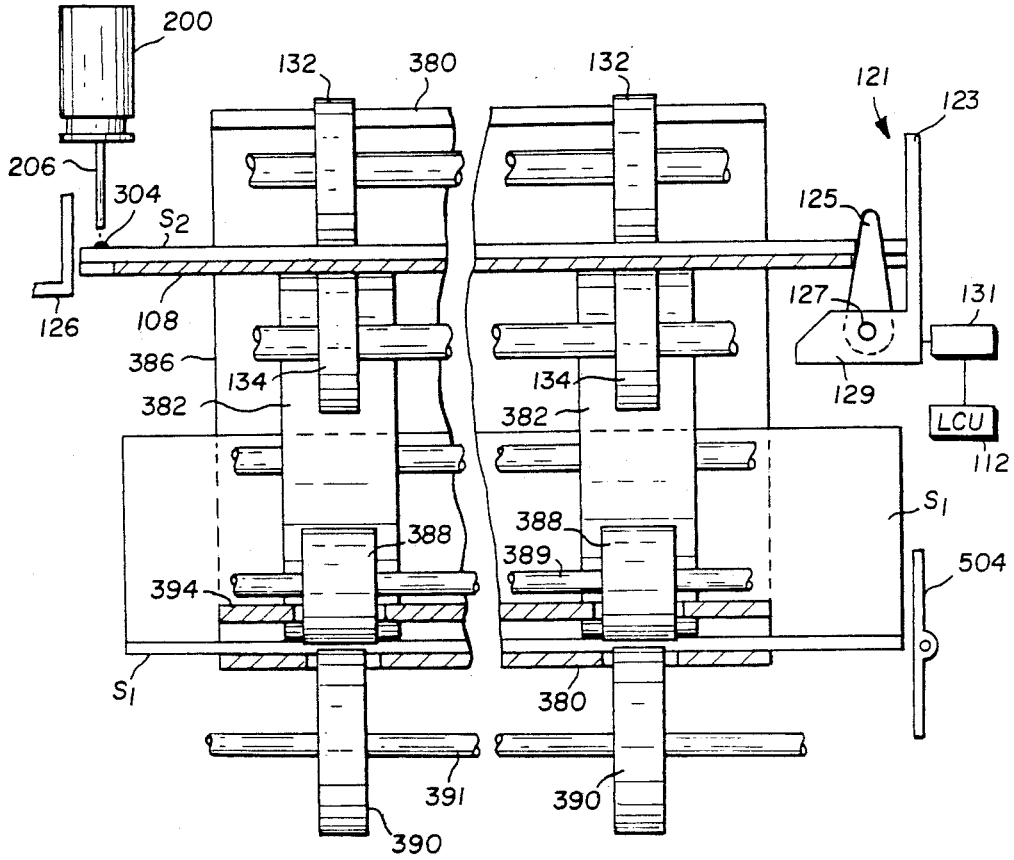
FIG. 4 is a view similar to FIG. 3 illustrating the first sheet temporarily stopped before its delivery to the assembly tray, and illustrating the second sheet just after it has been delivered to the binder.
Figure 5:
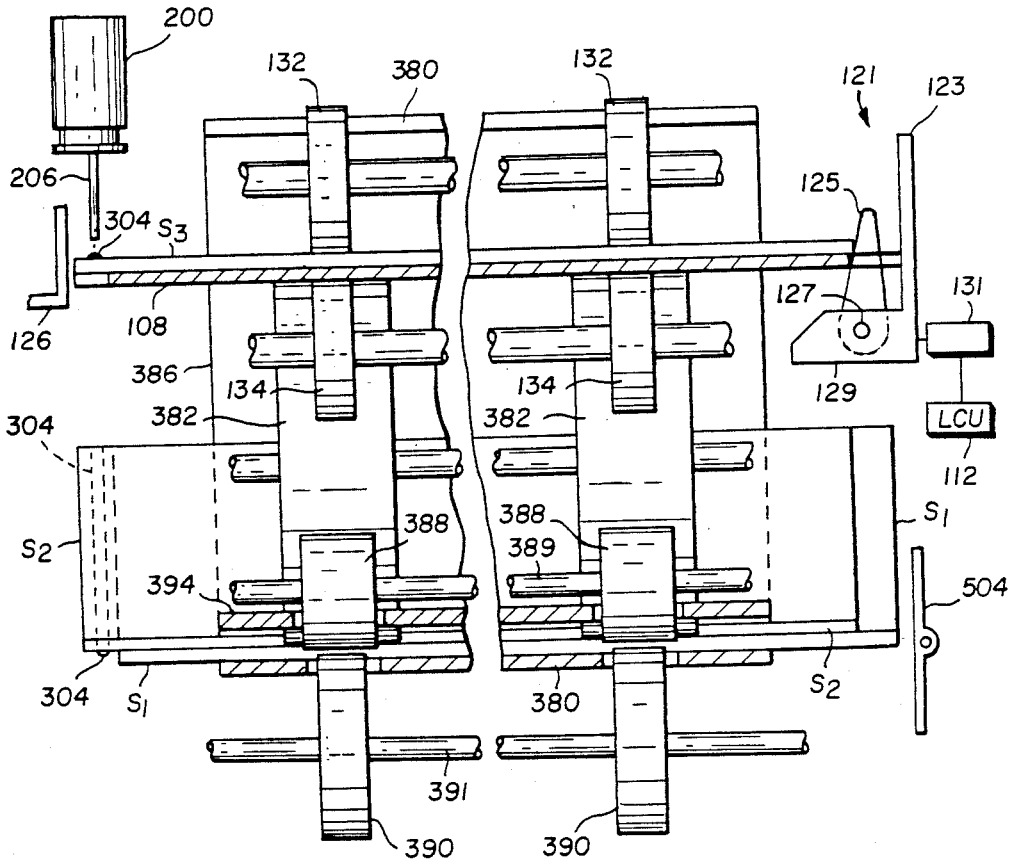
FIG. 5 is a view similar to FIG. 4 illustrating the first and second sheets offset from each other and temporarily stopped before delivery to the assembly tray, and also illustrating a third sheet just after its delivery to the binder.

When fingers 125 are in the retracted position illustrated in FIGS. 1 and 3, the first sheet of a set of , designated Sl in FIGS. 3–5, is driven across tray 108 and against the vertical side guide members 123 by the drive apparatus 67 and side jogger 126. It will be observed that the left side edge of sheet S1 is positioned to the side of, or offset from, tip 206 of the adhesive applicator. As indicated previously, ordinarily adhesive is not applied to the first sheet of a set of sheets. The first sheet is then driven by the puck drive mechanism 144, rollers 132, 134, 382, 384 along the curved guide 380 to the nip defined by rollers 388 and 390 As soon as the first sheet leaves tray 108, the LCU 112 energizes solenoid 131 to move fingers 125 to their respective FIG. 4 position wherein they are effective to provide a side guide for the second and each subsequent sheet of a set of sheets. Thus the fingers 125 are moved between their two positions as each set of sheets is processed by the binder. If desired, side jogger 126 can be moved in a left-to-right direction simultaneously with fingers 125 to insure that the sheets will be driven against either members 123 or fingers 125.

In accordance with the present invention shaft 391 for drive rollers 390 is operated through a clutch and brake assembly 393 so that the rollers can be alternately driven or stopped. Clutch and brake assembly 393 controls rollers 390 independent of the other driven rollers 132 and 382. The clutch and brake assembly 393 also is coupled to the logic and control unit 112. The LCU is programmed to declutch and brake the drive shaft 391 just prior to arrival of the first sheet S1 of the set at the nip defined by the rollers 388 and 390. Thus the first sheet is held up between trays 108 and 392 and is located generally between the rollers 382 and the curved guide 380. The beam strength of the sheet tends to hold it against guide 380 so that the second sheet of the set can be driven toward guide 380 and received between the first sheet and rollers 382. This permits the first two sheets to be temporarily stopped at the nip between rollers 388 and 390 in order to allow a brief period of time for completion of a preceeding booklet in tray 392 and removal of the booklet from the tray.

FIG. 4 of the drawings illustrates the second sheet S2 located in tray 108 in its aligned position between fingers 125 of the guide 121 and the side jogger 126. It will be observed that the left side edge of sheet S2 is located immediately beneath the tip 206 of the adhesive applicator so that a line of adhesive 304 can be applied to the sheet in the manner explained in the beforementioned copending patent application. FIG. 4 also illustrates sheet S1 stopped at the nip between rollers 388 and 390.

FIG. 5 of the drawings shows the location of the first three sheets of a booklet after the first two sheets have been delivered to the nip of rollers 388, 390. Thus in FIG. 5 sheets S1 and S2 both have been stopped by the rollers 388, 390 with the sheet S2 being offset to the left from sheet S1 by a sufficient distance so that the line of adhesive 304 on sheet S2 is in spaced relation to the adjacent side edge of sheet S1. This offsetting of the two sheets allows them to be simultaneously fed into guide 380 and held adjacent each other without the adhesive on sheet S2 being displaced or smeared onto sheet S1. In the absence of this offsetting of the two sheets, the wiping action between the sheets at the interface of the line of adhesive 304 on sheet S2 and the surface of sheet S1 could cause much of the adhesive of the leading portion of sheet S2 to be wiped off onto sheet 1 so that it would not be effective for binding together the leading edge portions of sheets S1 and S2 when they are later delivered to tray 392.

FIG. 5 also illustrates the third sheet S3 of a set of sheets in tray 108. This sheet has been delivered to the tray and aligned against the fingers 125 by jogger 126. Thus it is in position to have a line of adhesive 304 applied thereto when the sheet advancing means (comprising puck drive 144 and rollers 132, 134) drives sheet S3 past the applicator. However, before sheet S3 is driven from tray 108 the brake of clutch and brake assembly 393 is disengaged and the clutch engaged by the LCU 112 so that roller 388, 390 drive sheets S1 and S2 into tray 392 simultaneously. This avoids smearing of adhesive between sheets S2 and S3.

When the first two sheets are received in tray 392, side jogger 504 urges the sheets to the left as viewed in FIGS. 3–5 to bring them into alignment against a side guide located at the side of the tray opposite from the jogger 504. Similarly, the end jogger 396 drives the sheets forwardly and into alignment with the end guide 492. Additional sheets are fed to the tray 392 and the booklet formed in the manner described hereinbefore and in the beforementioned copending patent application.

An advantage of the present apparatus is that it allows a plurality of sets of sheets to be delivered seriatim to the binder at a high rate consistent with the output of modern duplicators and without the input rate being interrupted to permit the binder to function. Thus the binder can be operated with copier/duplicators producing copies at the rate of over 5,000 copies per hour without the copier/duplicators having to be programmed to allow a slight time delay between sets of sheets in order for booklets to be completely formed by the binder. This not only permits maximum output from the copier/duplicators but also eliminates the need for the copier/duplicators to be a slave of the binder unit, thereby simplifying the control of the copier/duplicator.

Although the invention has been described in connection with preferred embodiments thereof, it will be understood that variations and modifications can be effected within the spirit and scope of the sinvention as described hereinbefore and defined in the appended claims.

We claim:

1. In an adhesive binder for forming bound booklets from sets of sheets, the binder having means for applying liquid adhesive to a side edge portion of one or more sheets of each set of sheets, a tray where sheets of each set are assembled to form a bound booklet, and means for advancing the sheets seriatim toward the assembly tray, the improvement comprising:

means for temporarily stopping advancement of the first and second sheets of a set after such sheets have completely passed the adhesive applying means and before such sheets reach the tray so that there is a brief period of time for removing a booklet from the tray before sheets of the next booklet are advanced to the tray; and means for offsetting the first and second sheets so that when such sheets are stopped by the stopping means adhesive on one sheet is spaced from the side edge of the other sheet, thereby to avoid removal of adhesive from said one sheet.

2. The invention as set forth in claim 1 wherein the sheet advancing means comprises a drive shaft and sheet engaging means driven by the shaft, and the stopping means comprises clutch and brake means effective to drive the shaft when sheets are to be driven into the tray and to brake the shaft when sheets are to be temporarily stopped.

3. The invention as set forth in claim 1 wherein the offsetting means comprises sheet edge guide means engageable by each sheet, the edge guide means being effective to locate a side edge of the first sheet in one position and the side edge of the second sheet in a second position offset from the first position.

4. In an adhesive binder for forming bound booklets from sets of sheets, the binder having a receiving tray for receiving sheets of sets seriatim, an assembly tray where sheets of each set are assembled in a stack to form a bound booklet, an applicator for applying liquid adhesive to a side edge portion of a surface of one or more sheets of each set of sheets before the sheets reach the assembly tray, and means for advancing the sheets seriatim from the receiving tray toward the assembly tray, the sheet advancing means comprising sheet drive means and at least one drive shaft for driving the sheet drive means, the improvement comprising:

means for braking said drive shaft for temporarily stopping advancement of the first and second sheets of a set received by the receiving tray after such sheets have been driven from the receiving tray and before such sheets reach the assembly tray so that there is a brief period of time for removing one completed booklet from the assembly tray before the first two sheets of the next booklet are advanced to the assembly tray; and means for offsetting the location of the first and second sheets in the receiving tray so that when such sheets are stopped by braking the drive shaft adhesive on one sheet is spaced to one side of the side edge of the other sheet, thereby to avoid removal of adhesive from said one sheet.

5. The invention as set forth in claim 4 wherein the offsetting means comprises side edge guide means for aligning sheets in the receiving tray, and the sheet advancing means being effective to advance the first and second sheets from the receiving tray part way to the assembly tray before the sheets are stopped by the braking means.

6. The invention as set forth in claim 5 wherein the sheet guide means comprises first means engageable by the first sheet for locating the sheet in one position in the receiving tray, and second means movable between (1) a first position to permit the first sheet to engage the first means and (2) a second position to stop and align the second and subsequent sheets of a set before they reach the first means.

7. In a method for forming bound booklets from sets of sheets by applying liquid adhesive to a side edge portion of one or more sheets of each set of sheets, advancing the sheets to an assembly area, and assembling the sheets of each set together to form a bound booklet, the improvement comprising:

temporarily stopping advancement of the first and second sheets of a set after adhesive has been applied to the second of such sheets and before such sheets reach the assembly area so that there is a brief period of time for removing a booklet from the assembly area before sheets of the next booklet are advanced to the assembly area; and offsetting the first and second sheets so that when such sheets are stopped adhesive on the second sheet is spaced to one side of the first sheet, thereby to avoid removal of adhesive from the second sheet.

8. In an adhesive binder for forming bound booklets from sets of sheets, the binder having a tray where sheets of each set are assemblied to form a bound booklet, means for advancing the sheets seriatim toward the assembly tray, and means for applying liquid adhesive to a side edge portion of one or more sheets of each set of sheets before they reach to the tray, the improvement comprising:

means for temporarily stopping advancement of the first and second sheets of a set after such sheets have passed the adhesive applying means and before such sheets reach the tray so that there is a brief period of time for removing a booklet from the tray before sheets of the next booklet are advanced to the tray; and means for offsetting the side edges of the first and second sheets before the sheets reach the stopping means so that when such sheets are stopped by the stopping means adhesive on the side edge portion of one sheet is spaced from the side edge of the other sheet to avoid wiping of adhesive from the side edge portion of said one sheet.

9. In a method for forming bound booklets from sets of sheets by applying liquid adhesive to a side edge portion of one or more sheets of each set of sheets, advancing the sheets to an assembly area, and assembling the sheets of each set together to form a bound booklet, the improvement comprising:

temporarily stopping advancement of the first and second sheets of a set after adhesive has been applied to the second of such sheets and before such sheets reach the assembly area so that there is a brief period of time for removing a booklet from the assembly area before sheets of the next are advanced to the assembly area; and offsetting the side edges of the first and second sheets before adhesive is applied to the second sheet so that when such sheets are stopped adhesive on the side edge portion of the second sheet is spaced from the side edge of the first sheet, thereby to avoid removal of adhesive from the second sheet by the first sheet.

* * * * *